US010256062B2

(12) United States Patent
Strangfeld et al.

(10) Patent No.: US 10,256,062 B2
(45) Date of Patent: Apr. 9, 2019

(54) DEVICE FOR THERMALLY TRIPPING OR DISCONNECTING AN OVERVOLTAGE PROTECTION DEVICE

(71) Applicant: DEHN + SÖHNE GMBH + CO. KG, Neumarkt/Opf. (DE)

(72) Inventors: Uwe Strangfeld, Nürnberg (DE); Stephan Hierl, Neumarkt (DE)

(73) Assignee: DEHN + SÖHNE GMBH + CO. KG, Neumarkt/Opf. (DE)

( * ) Notice: Subject to any disclaimer, the term of this patent is extended or adjusted under 35 U.S.C. 154(b) by 221 days.

(21) Appl. No.: 15/308,779

(22) PCT Filed: May 29, 2015

(86) PCT No.: PCT/EP2015/061931
§ 371 (c)(1),
(2) Date: Nov. 3, 2016

(87) PCT Pub. No.: WO2015/185447
PCT Pub. Date: Dec. 10, 2015

(65) Prior Publication Data

US 2017/0186575 A1 Jun. 29, 2017

(30) Foreign Application Priority Data

Jun. 4, 2014 (DE) ..... 10 2014 008 366

(51) Int. Cl.
*H01C 7/12* (2006.01)
*H01T 1/14* (2006.01)
(Continued)

(52) U.S. Cl.
CPC ..... *H01H 37/76* (2013.01); *H01C 7/126* (2013.01); *H01H 37/08* (2013.01); *H01H 37/32* (2013.01);
(Continued)

(58) Field of Classification Search
CPC ..... H01H 37/08; H01H 37/32; H01H 37/60; H01H 37/76; H01H 2037/768; H01T 1/14; H01C 7/126
(Continued)

(56) References Cited

U.S. PATENT DOCUMENTS 8,582,264 B2 11/2013 Durth et al. ..... 361/91.1
2013/0337691 A1 12/2013 Striewe et al. ..... 439/625

FOREIGN PATENT DOCUMENTS

DE 10 2005 045 778 3/2007 ..... H01H 85/36
DE 10 2006 037 551 3/2012 ..... H02H 5/04
(Continued)

OTHER PUBLICATIONS

The Notification Concerning Transmittal of International Preliminary Report on Patentability (Chapter I of the Patent Cooperation Treaty), in English, dated Dec. 15, 2016, which was issued by the International Bureau of WIPO in Applicant's corresponding international PCT application having Serial No. PCT/EP2015/061931, filed on May 29, 2015.
(Continued)

*Primary Examiner* — Kevin J Comber
(74) *Attorney, Agent, or Firm* — Bodner & O'Rourke, LLP; Gerald T. Bodner; Christian P. Bodner

(57) ABSTRACT

The invention relates to a device for thermally disconnecting or tripping an overvoltage protection device, comprising: a locking element (A1), on which a first force (F1) acts, and which is fixed in such a way that same is released when a limit temperature is exceeded; and a slider (S1) which is blocked in a first state (Z1) by the fixed locking element (A1), and on which a second force (F2) acts in order to transfer same into a second state (Z2) when the locking element (A1) is released.

4 Claims, 5 Drawing Sheets

(51) Int. Cl.

| | |
|---|---|
| ***H01H 37/08*** | (2006.01) |
| ***H01H 37/32*** | (2006.01) |
| ***H01H 37/60*** | (2006.01) |
| ***H01H 37/76*** | (2006.01) |

(52) U.S. Cl.
CPC ..... *H01H 37/60* (2013.01); *H01T 1/14* (2013.01); *H01H 2037/768* (2013.01)

(58) Field of Classification Search
USPC ..... 361/103
See application file for complete search history.

(56) References Cited

FOREIGN PATENT DOCUMENTS

| | | | |
|---|---|---|---|
| DE | 10 2010 061 110 | 6/2012 | ..... H01H 37/76 |
| DE | 20 2014 002 496 | 5/2014 | ..... H01C 7/12 |
| EP | 2 355 274 | 8/2011 | ..... H01C 7/12 |
| WO | WO 2007/093572 | 8/2007 | ..... H01C 7/12 |
| WO | WO 2013/066538 | 5/2013 | ..... H01C 7/12 |

OTHER PUBLICATIONS

The English translation of the International Preliminary Report on Patentability (Chapter I of the Patent Cooperation Treaty), dated Dec. 6, 2016, which was issued by the International Bureau of WIPO in Applicant's corresponding international PCT application having Serial No. PCT/EP2015/061931, filed on May 29, 2015.

The Written Opinion of the International Searching Authority, in English (dated Dec. 6, 2016—mailed with the English translation of the International Preliminary Report on Patentability), which was issued by the International Bureau of WIPO in Applicant's corresponding international PCT application having Serial No. PCT/EP2015/061931, filed on May 29, 2015.

The International Search Report, in English, dated Aug. 5, 2015, which was issued by the International Bureau of WIPO in Applicant's corresponding international PCT application having Serial No. PCT/EP2015/061931, filed on May 29, 2015.

DEVICE FOR THERMALLY TRIPPING OR DISCONNECTING AN OVERVOLTAGE PROTECTION DEVICE

The invention relates to a device for thermally tripping or disconnecting an overvoltage protection device, comprising a locking element on which a first force acts and which is fixed in such a way that said locking element is released when a limit temperature is exceeded, and a slider which is blocked in a first state by the fixed locking element, and on which a second force acts in order to transfer said slider to a second state when the locking element is released, according to the preamble of claim 1.

DE 10 2006 037 551 B4 shows a locked disconnecting device, wherein a movable shaped solder part is placed under a force by a pretensioned spring, but is unable to yield from the same as long as a solder pin blocks the path of movement. If the solder pin melts as a result of thermal overloading which is caused by a high current for example, the shaped solder part, and thus a slider, is moved so that an electric circuit is closed which emits a warning signal for example.

DE 10 2010 061 110 A1 also discloses a thermal disconnecting device, wherein a first conductor section is galvanically coupled to a second conductor section via a thermally releasable contact. In the case of excessive temperature, the contact point is released and the first conductor section is conveyed to an insulating section by a force acting continually thereon, so that an electrical connection is no longer possible between the two conductor sections.

DE 10 2005 045 778 A1 relates to a temperature fuse. Two conductor sections are connected via a third conductor section. If there is an excessive temperature, said conductor section is moved by an actuated pin in such a way that it no longer acts as a connecting element between the two other conductor sections and interrupts an electric circuit closed via the conductor sections. A controller compares a temperature detected by a sensor with a predetermined limit temperature and triggers a movement of the pin when the limit temperature has been exceeded. Instead of an active solution with a controller and a sensor it is also possible to realise a passive solution by means of a pretensioned spring or bending element in which a relaxation movement is blocked by a mechanical fuse. The mechanical fuse is triggered upon exceeding a limit temperature, as a result of which the relaxation movement of the spring or bending element conveys the connecting element from the conductor section and thus interrupts the electric circuit.

The disadvantages of the prior art are especially the high costs, the need for maintenance and the lack of sturdiness of the active solutions. Passive solutions on the other hand are impaired in such a way that unnecessarily high forces act on the locking elements because simultaneously with the interruption by the forces a further action such as a movement of a slider, a switching contact or the like must be carried out. This can lead to "gradual tripping" of the disconnecting device before a relevant thermal overload has actually occurred.

It is the object of the present invention to provide a further developed device for the thermal tripping or disconnecting of an overvoltage protection device which provides sufficient mechanical forces for actuating a display, a switching contact or the like.

This object is achieved by a device for the thermal tripping of a slider of an overvoltage protection device according to claim 1. The dependent claims relate to at least preferred further developments.

A device in accordance with the invention for thermally tripping an overvoltage protection device comprises a locking element. The locking element is fixed to the device. The fixing has sufficient function up to a limit temperature, by means of which the locking element remains fixedly at its position up to said limit temperature. When said limit temperature is exceeded, the fixing loses its function so that the locking element is able to be released from its previously assumed position. A first force acts on the locking element in the fixed state. Said force only ensures that the locking element moves from its original position once the fixing has become inoperable due to an excessive temperature.

Furthermore, the device in accordance with the invention comprises a slider which in a first state is blocked indirectly by the fixed locking element. A second force acts on the slider. The second force transfers the slider to a second state when the locking element is released.

The device in accordance with the invention further comprises a holding device. It is connected to the slider, especially in a releasable or fixed manner. The locking element indirectly blocks the slider by means of the holding device. The holding device is formed in such a way that the second force acting on the slider substantially only acts on the locking element in a frictionally engaged manner and not in the direction of movement of the first force.

An electric circuit can be closed by the locking element. This can especially occur in such a way that the locking element is formed in an electric conductive way. Alternatively or in addition, an electric circuit can be closed by the slider when it is in the first state. Said electric circuit is preferably interrupted when the slider moves to the second state. In particular, said electric circuit can be interrupted in the second state. The locking element can also be an electrical component such as a varistor or a gas arrester which is fixed by soldering to a circuit board.

It is the fundamental concept of the invention to decouple the locking element from the second, greater force which is necessary to move the slider and to trigger an action. This occurs in such a way that substantially no interlocking forces originating from the second force act on the locking element. Only the first force acts in an interlocking manner, i.e. directly, on the locking element. The second force substantially acts in a frictionally engaged manner alone, i.e. indirectly on the locking element. This reduces a negative effect of the second force on the fastening means, e.g. the solder for the locking element. In particular, a high force can be realised as a second force which is necessary for moving the slider without thus pressing the locking element in the long run from its fixing and thus subjecting the device to "gradual tripping".

In one embodiment, the first force is generated by a pretensioned spring according to a first aspect. It can especially be a pressure spring which only provides the force necessary for displacing the locking element, without providing any necessary excess force. The first force can also be produced in an analogous manner by a tension spring. Alternatively or in addition, the first force can also be produced by a mass, as a result of which a gravitational force acts on the locking element. According to a second aspect of this embodiment, the second force can also be generated by a pretensioned spring, which can be a tension spring or a pressure spring. Alternatively or in addition, this force can also be generated by a mass, especially by the mass of the slider.

The holding device comprises at least two pincer-like, resilient jaws in one embodiment, which jaws rest in the first state on the fixed locking element and a surrounding area of the slider. The surrounding area within the terms of the invention can especially be a housing or an intermediate wall of the housing of the device, or a device which is connected to the device in accordance with the invention. In particular, the jaws are formed to be elastically resilient so that they reach the original state again after a forced deformation. The holding element can thus especially be reused again.

The jaws are preferably arranged in such a way that normal forces acting on the locking element substantially compensate each other. This can especially be realised by two opposite jaws. It can also be considered to provide a variant with three jaws which are each offset by 60° from each other, so that substantially in this case too no resulting force acts on the locking element. According to the same principle, more jaws can also preferably be arranged which are situated even closer together. One or several jaws can preferably comprise a bevelled stepping, which jaws are supported by the surrounding area, especially a housing or a separating wall of the housing, in such a way that the second force produces a yielding of one or several jaws when they are no longer blocked by the released locking element. In particular, a yielding of one or several jaws is blocked in the first state, such that they are pressed by the stepping against the locking element and there is substantially no space for yielding. The stepping and the locking element ensure that the greater, second force is diverted to the surrounding area and does not impair the fixing of the locking element.

A stepping can preferably be part of a groove which is supported against the respective cam of the surrounding area. Alternatively, a stepping can be part of a cam which is supported on a respective groove of the surrounding area. In particular, the holding device and/or the slider can be positioned in a simple and precise way during installation by a groove-and-cam connection, especially without an occurring subsequent displacement.

In one embodiment, the temperature-dependent fixing of the locking element is realised by a solder connection. An electrical component can thus be connected directly by the fixing of the locking element. In particular, this electric circuit can be interrupted when the fixing is released due to thermal overload. This electric circuit can alternatively not be interrupted by releasing the fixing, but preferably only once the locking element is moved by the first force. Alternatively or in addition, the fixing can be realised by a temperature-dependent adhesive. In one variant, the fixing can be realised by a wax connection, especially in addition.

In one embodiment, the device comprises a wedge surface which lifts the locking element relative to its surrounding area in which it is fixed in the first state when it is pressed in the transition to the second state against the wedge. In particular, the wedge is disposed collinearly in relation to the first force which displaces the locking element. As a result, the locking element can especially be released from the fixing in a more rapid and/or effective manner when a thermal overload occurred previously. Furthermore, an electrical connection is preferably disconnected in a more secure manner if an electric circuit is closed via the locking element in the first state, especially by solder fixing. In particular, the wedge can counteract the formation of an arc when the locking element is rapidly removed from the existing electric potential.

In one embodiment, the element which generates the first force, i.e. a spring used for this purpose in particular, is supported on the slider. Alternatively or in addition, the force-generating elements can be arranged in such a way that the first force and the second force are disposed in parallel with respect to each other, especially collinearly. A compact and/or modular configuration of the device can thus be realised.

In one embodiment, the device comprises a display surface which indicates the respective state (first state, second state) of the slider. The display surface can be arranged either fixedly or releasably on the slider.

In one embodiment, the device comprises a telecommunications device which indicates the respective state (first state, further state) of the device. In particular, the telecommunications device is directly connected to the slider and/or is triggered by the said slider. The telecommunications device is preferably set up for closing or interrupting an electric circuit, so that according to one variant the electric circuit is interrupted in the first state and closed in the second state. A switchover to a second state can thus be actively realised. Alternatively or in addition, it is also possible that an electric circuit is closed by the telecommunications device in a first state and interrupted in a second state.

In one embodiment, the locking element and/or the holding device is coated in a friction-reducing manner. As a result, the frictional forces generated by the holding device via the locking element by the second force can especially be reduced. In particular, a more comprehensive decoupling of the second force from the locking element is thus possible, so that substantially only the first force acts on the locking element and rapid movement of the locking element from the jaws is provided.

According to one embodiment, the contact surface between the locking element and the holding device is small. In particular, one or several jaws of the holding device can be formed in such a way that they substantially only rest in one point on the locking element. Alternatively or in addition, the locking element can also be formed in such a way that the holding device can substantially rest thereon in only one point. The locking element can preferably be formed in the manner of a wedge or cone, so that during the transition to the second state, after a first displacement, the locking element jumps out of its fixing. In particular, the holding device, especially one or several jaws, can be bevelled in such a way that after the first displacement during transition to the second state the force decoupling is removed and the locking element is additionally accelerated by the second force.

Features of different embodiments can be combined with each other advantageously in further embodiments that are not shown. Further advantages and features are provided in the dependent claims and the embodiments, which are shown in the drawings in a partly schematic way:

Figure 1:
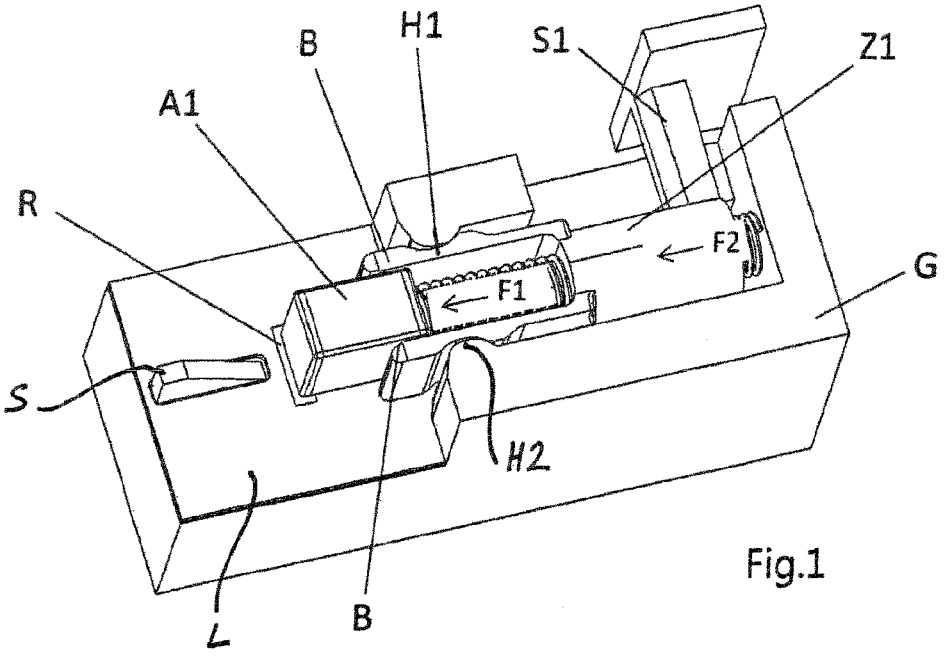
FIG. 1 shows an embodiment in accordance with the invention in a first state.

FIG. 1 shows a device for thermally tripping or disconnecting an overvoltage protection device, comprising a display surface and a slider (S1) in the first state (Z1). A force (F2) is applied to said slider by a coil spring. The coil spring is supported for this purpose on a housing (G) in which the slider (S1) is mounted. The coil spring is used as an energy storage unit, wherein the force (F2) is high enough to move the slider (S1). The slider (S1) comprises a holding device which is realised by two opposite jaws (B).

A locking element (A1) in form of a varistor for example is further fixed to a circuit board (L). The fixing occurs via solder connections (not shown) on two metallic conductor tracks (R) which hold the locking element (A1) at the front and the back and make contact with said element.

The jaws (B) of the holding device (H1) are formed in a resilient manner, especially consisting of a flexible plastic material. The jaws (B) further each comprise an outwardly oriented groove. They are used to respectively accommodate a cam (H2) which is realised as a part of the housing (G). The slider (S1) is pressed in the direction of the locking element (A1) by the second force (F2). This force is diverted to the jaws (B) by the cams (H2) which engage in the groove of the jaws (B) in such a way that they are pressed inwardly.

A yielding of the jaws (B) to the inside is prevented by the locking element (A1) however, which is arranged between the ends of the jaws (B). A movement of the jaws (B) towards each other is thus prevented and therefore also a movement of the slider (S1). In this first state in which the locking element (A1) is tightly fixed to the wiring support, the locking element (A1) prevents a movement of the jaws (B) of the slider towards each other. The pincers of the jaws can therefore not be pressed together. A movement of the slider is prevented by the latched connection (H1; H2).

The normal forces compensate each other by the oppositely arranged jaws (B), which normal forces are applied via the jaws (B) by the second force (F2) to the holding device (H1). This leads to the result that the resulting normal force on the locking element (A1) disappears. The second force (F2) is thus decoupled from a direct effect on the locking element (A1) in the first state.

Figure 2:
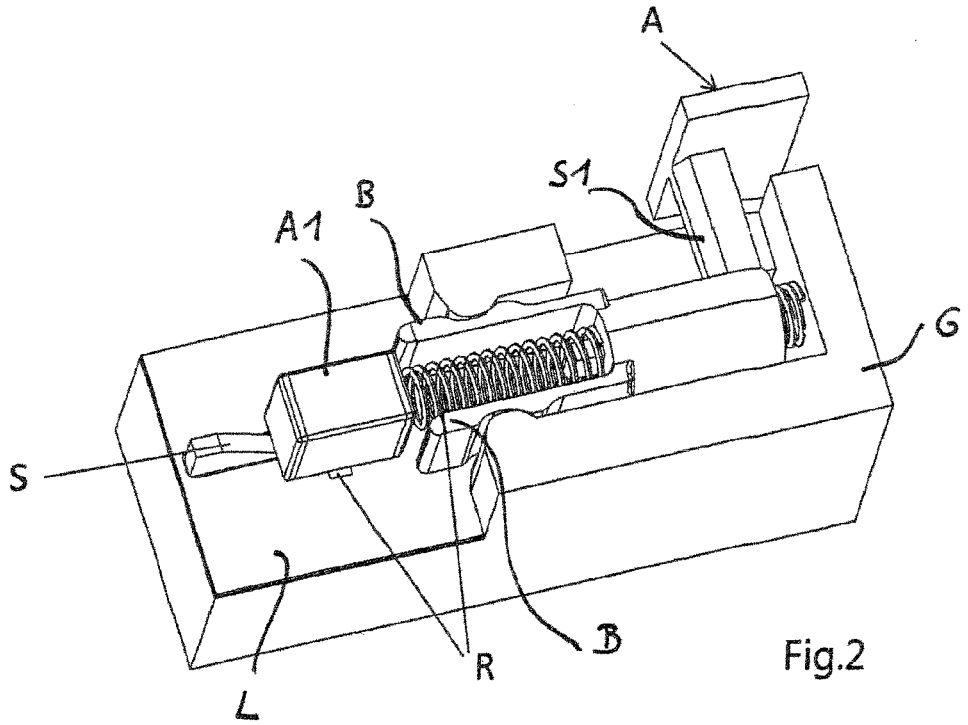
FIG. 2 shows an embodiment in accordance with the invention with a released locking element.

FIG. 2 shows the device for the thermal tripping of an overvoltage protection device of FIG. 1. The fixing of the locking element (A1) has been released by exceeding a limit temperature and the device moves to the second state (Z2).

A spring is disposed between the jaws (B), which is supported on the slider (S1) and directly exerts a first force (F1) on the locking element (A1) in a pretensioned state. This force leads to an acceleration of the locking element (A1) when it has been released from fixing. The spring is dimensioned and the first force (F1) on the locking element (A1) is just proportioned in such a way that the intended effect occurs, i.e. the acceleration of the locking element (A1) after the release of the fixing.

Figure 3:
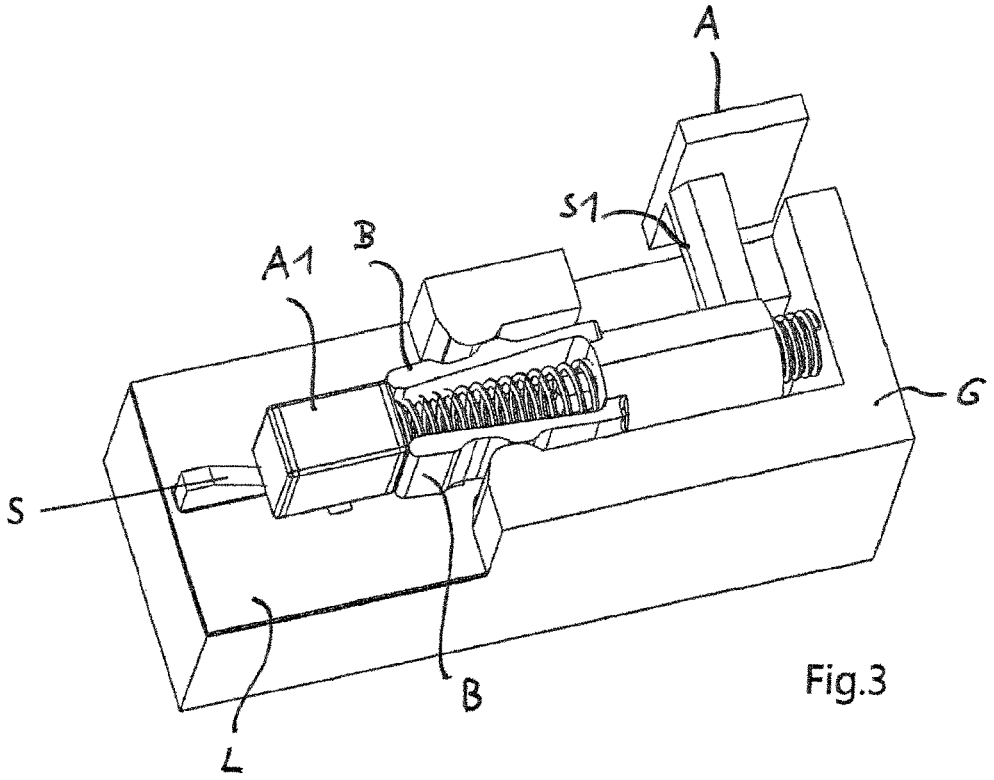
FIG. 3 shows an embodiment in accordance with the invention during transition to the second state.

FIG. 3 shows the device according to FIGS. 1 and 2, wherein the transfer of the state is in a second phase. The locking element (A1) was pressed out of the jaws (B) by the first force (F1). The jaws (B) of the holding devices can thus move to the inside. The jaws (B) are pressed inwardly by the second force (F2) via the latching means, especially by the cams of the housing, so that the right side of the groove of the jaws (B) no longer blocks a movement of the slider (S1). The latched connection (H1) is thus overcome. The second force (F2) accelerates the slider (S1) and thus also moves the display surface (A) to the left. This indicates a tripping of the overvoltage protection device for example.

A fin (S) is situated in the drawing on the left side adjacent to the fixing of the locking element (A1), which fin is used to lift the locking element (A1) from its fixing and to especially completely separate the same. This occurs in such a way that the locking element (A1) is pushed by the first force (F1) onto the fin (S). It is ensured by this complete separation that the electrical connection which occurs by the fixing is also completely interrupted and thus the electric circuit closed thereby is also interrupted. In particular, the formation of an arc is thus also excluded.

Figure 4:
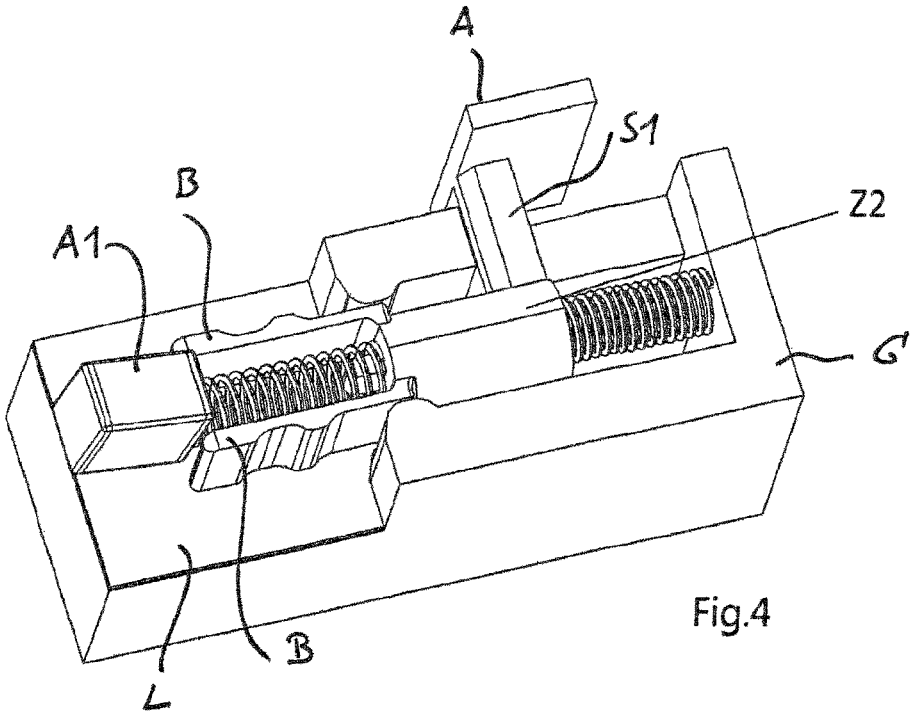
FIG. 4 shows an embodiment in accordance with the invention in a second state.

FIG. 4 shows the device according to FIGS. 1, 2 and 3 in the second state (Z2). The slider (S1) is moved completely to the left. The flexible jaws (B) of the holding device (H1) are in their initial form again. The locking element (A1) is accelerated via the fin (S) away from the fixing and the wiring support, especially the live conductor tracks (R). The force (F2) acts in a supporting manner in this case.

Figure 5:
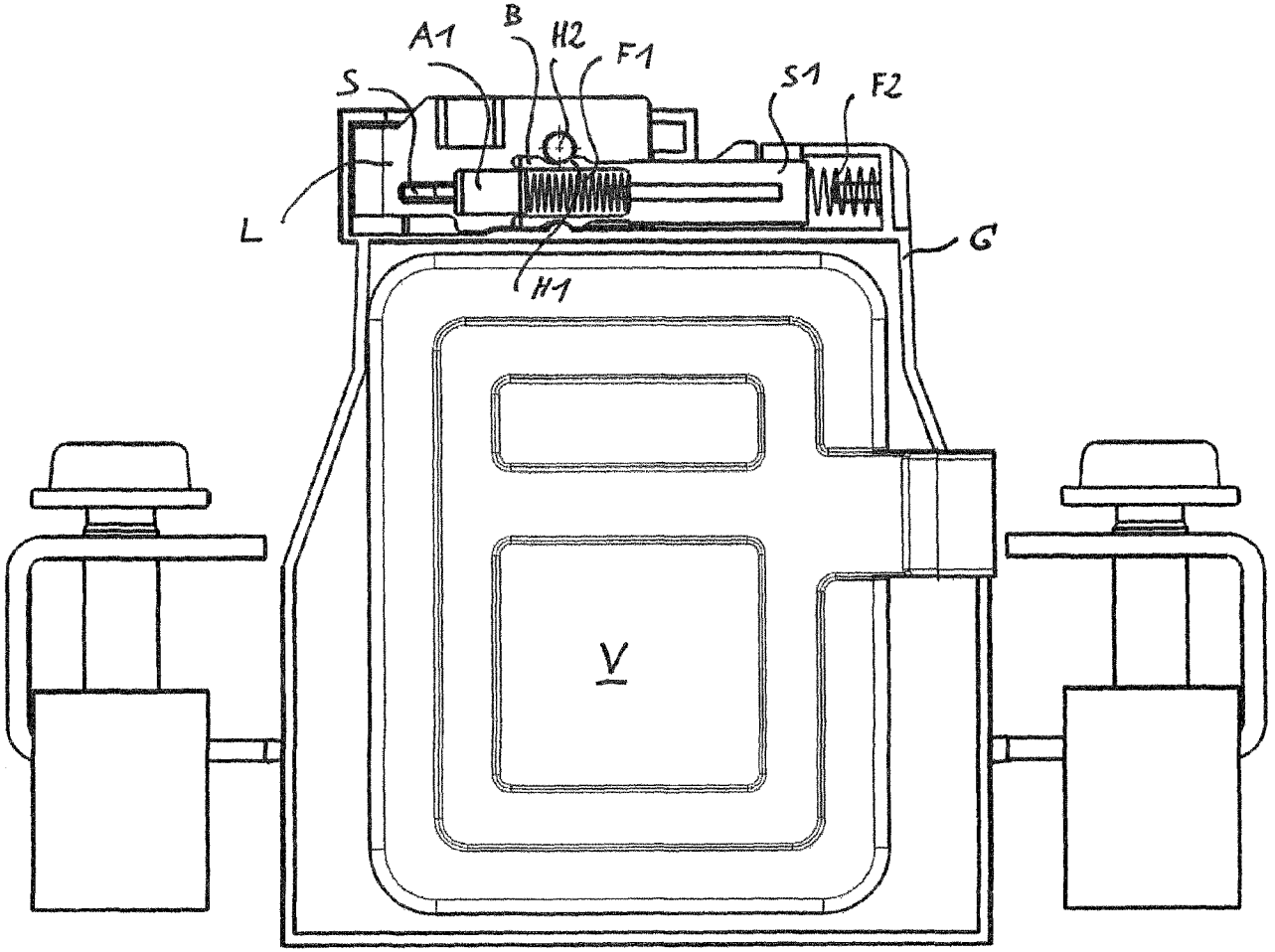
FIG. 5 shows an embodiment of the invention that has been realised in practice.

FIG. 5 shows a view of a practically realised embodiment of the invention with a housing (G) which is partly broken away. This embodiment concerns a device for overvoltage protection, wherein at least one varistor (V) is used as an overvoltage protection element. Said varistor (V) is situated within the housing (G). The actual device for thermally tripping and disconnecting the varistor (V) is also integrated in the housing (G).

The locking element (A1) is also situated in this embodiment on a circuit board (L) and makes contact there with the existing conductor tracks and connecting surfaces (not shown in the drawing), especially by soldering. The slider (S1) is subject to the pretensioning force (F2). A further means generating a pretensioning force (F1) is situated within the slider (S1), which is especially also a spring. Said spring presses with its left end on a face end of the locking element (A1). The force (F1) is lower than the force (F2).

The elastic jaws (B) are prevented from carrying out a movement directed against each other by clamping on the locking element (A1), at least for such a time until the locking element (A1) is tightly connected to the circuit board (L). When a limit temperature is reached, this connection, which is especially a solder connection, is released and the locking element is moved and lifted by means of the force (F1) from its original position in the direction of the wedge-shaped fin (S). As a result, the jaws (B) can now be moved to such a position that the latched connection (H1; H2) is removed and the greater force (F2) on the slider (S1) allows a rapid movement of said slider.

LIST OF REFERENCE NUMERALS

S1—Slider
A1—Locking element
H1; H2—Latched connection
F1—First force
F2—Second force
A—Display surface
R—Conductor track; connecting surface
G—Housing
B—Jaws
S—Fin
Z1—First state
Z2—Second state
V—Varistor

The invention claimed is:

1. A device for thermally tripping or disconnecting an overvoltage protection device, comprising:

a locking element (A1) on which a first force (F1) acts and which is fixed to the device in such a way that said locking element is released when a limit temperature is exceeded, wherein the temperature-dependent fixing of the locking element (A1) is realised by a solder connection, an adhesive and/or by a wax connection;

a slider (S1) which is blocked in a first state (Z1) by the fixed locking element (A1), and on which a second force (Z2) acts in order to transfer said slide to a second state (Z2) when the locking element (A1) is released;

characterized by a latching-holding device (H1) which is connected to the slider (S1) and by means of which the locking element (A1), which is configured as an electrical component and is fixed to a circuit board, blocks the slider indirectly and by means of which the second force (F2) only acts as a partial force component in a frictionally engaged clamping manner on the locking element (A1), wherein the latching-holding device (H1) comprises at least two elastic, resilient jaws (B) which are supported in the first state (Z1) against the fixed locking element (A1) and against a surrounding area (G) of the slider (S1), the jaws (B) further each comprising an outwardly directed groove for accommodating one cam (H2) each, the second force (F2) being redirected by the cams (H2) onto the jaws (B) in order to press the jaws (B) inwardly.

2. A device according to claim 1, characterized in that the first force (F1) and/or the second force (F2) is produced by a pretensioned spring and/or by a mass.

3. A device according to claim 1, characterized by a wedge-shaped fin (S) which lifts the locking element (A1) relative to its surrounding area (G) on which it is fixed in the first state (Z1) when it is pressed against the wedge-shaped fin (S) during transfer into the second state (Z2).

4. A device according to claim 1, characterized in that the force-generating elements are arranged in such a way that the first force (F1) and the second force (F2) are directed in parallel to each other and F1≤F2.

* * * * *